United States Patent [19]

Waski

[11] 4,111,429

[45] Sep. 5, 1978

[54] GAME APPARATUS

[75] Inventor: Jane Waski, New York, N.Y.

[73] Assignee: Janys Designs Limited, New York, N.Y.

[21] Appl. No.: 759,689

[22] Filed: Jan. 17, 1977

[51] Int. Cl.[2] ..... A63F 3/00

[52] U.S. Cl. ..... 273/271; 273/144 A; 221/233

[58] Field of Search ..... 273/135 R, 135 AC, 135 B, 273/144 R, 144 A, 1 R, 95 R; 221/202, 233, 235, 261, 266

[56] References Cited

U.S. PATENT DOCUMENTS

| | | | |
|---|---|---|---|
| 1,321,382 | 11/1919 | Mason | 221/235 |
| 1,562,197 | 2/1924 | Andrew | 273/135 B |
| 1,760,642 | 5/1930 | Graham | 273/135 B |
| 3,472,421 | 10/1969 | Baller | 221/202 |
| 3,679,208 | 7/1972 | Carrano, Jr. | 273/95 R |
| 3,856,312 | 12/1974 | Dabrowski | 273/144 A |

*Primary Examiner*—Robert W. Michell
*Assistant Examiner*—Arthur S. Rose
*Attorney, Agent, or Firm*—Blum, Moscovitz, Friedman & Kaplan

[57] ABSTRACT

A game apparatus having random gamepiece selection for a number of players. The game apparatus has a hopper for holding a plurality of coded gamepieces and player controlled mechanisms for random selection of the gamepieces and troughs for holding the gamepieces so selected. Each player has a coded game board for positioning and holding corresponding selected gamepieces.

9 Claims, 10 Drawing Figures

FIG. 7
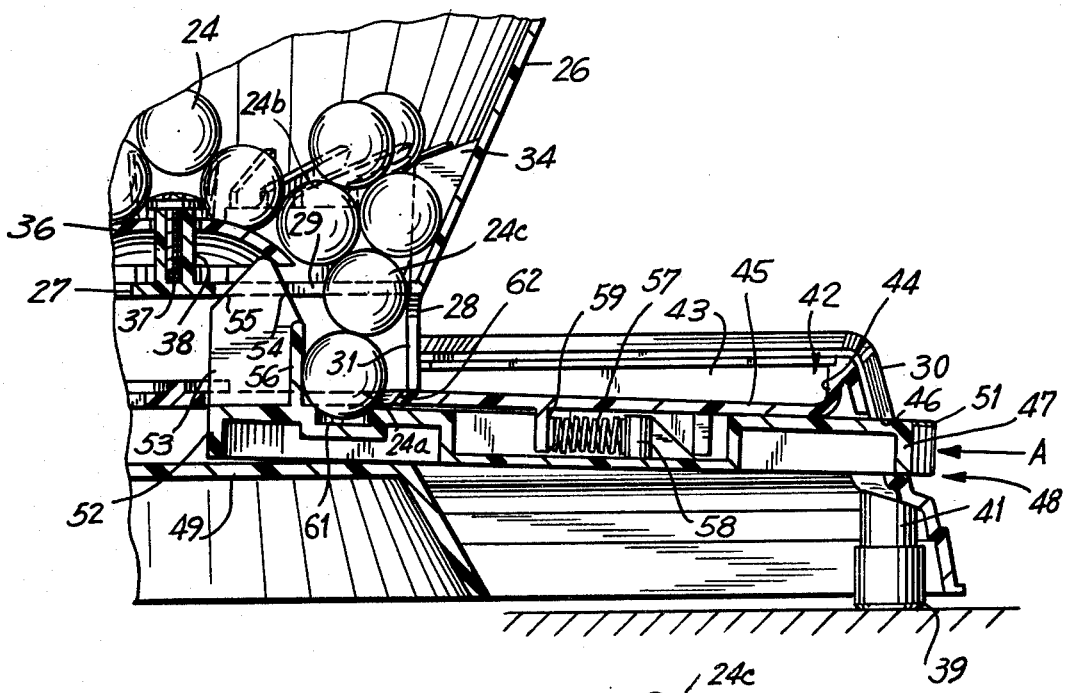
FIG. 8
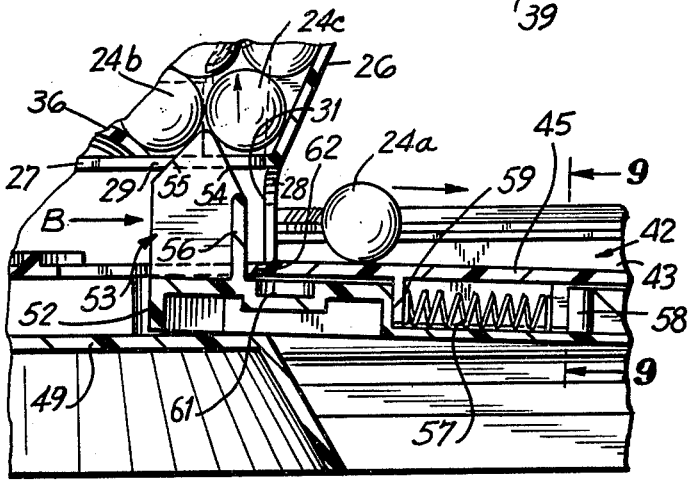
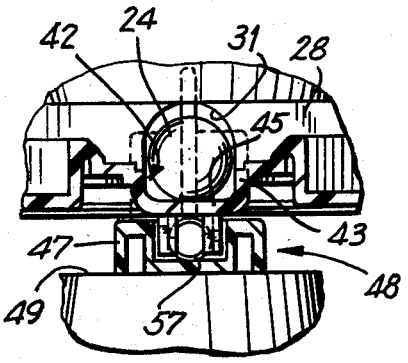
FIG. 9

GAME APPARATUS

BACKGROUND OF THE INVENTION

This invention relates generally to a random gamepiece selection game and apparatus. While a variety of games and apparatus are known in the art, the present game and apparatus presents a novel approach to games and random gamepiece selection apparatus for a number of players that is relatively simple and yet provides a challenge to the eye-hand coordination of the players and maintains player interest through competition. The development of such eye-hand coordination skill is important in a child's development.

SUMMARY OF THE INVENTION

Generally speaking, in accordance with the invention, a random gamepiece selection device for a number of players is provided. The device has a base and a hopper for holding a plurality of coded gamepieces such as marbles. Each player has a marble selection mechanism which permits simultaneous selection of marbles from the hopper by all players. The selection mechanism selects only one marble at a time and delivers the selected marble to a trough facing the player. Each player has a game board for holding the selected marbles in accordance with the rules of the game.

Accordingly, it is an object of this invention to provide a game having play value and interest.

Another object of this invention is to provide an improved gamepiece selection device that is capable of selecting a number of gamepieces simultaneously for a number of players.

A further object of this invention is to provide a game capable of challenging the eye-hand coordination of its players.

Still another object of this invention is to provide an improved random gamepiece selection device that will efficiently select all of the gamepieces.

Yet another object of this invention is to provide an improved random gamepiece selection device that is easy to operate by young children.

Still other objects and advantages of the invention will in part by obvious and will in part be apparent from the specification.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 7 is a view similar to FIG. 5, but with the marble release handle depressed;

FIG. 8 is a view similar to FIG. 5, but showing the apparatus after the marble release handle has been depressed and released;

FIG. 9 is a partial sectional view taken along line 9—9 of FIG. 8.

DESCRIPTION OF THE PREFERRED EMBODIMENT

Figure 1:
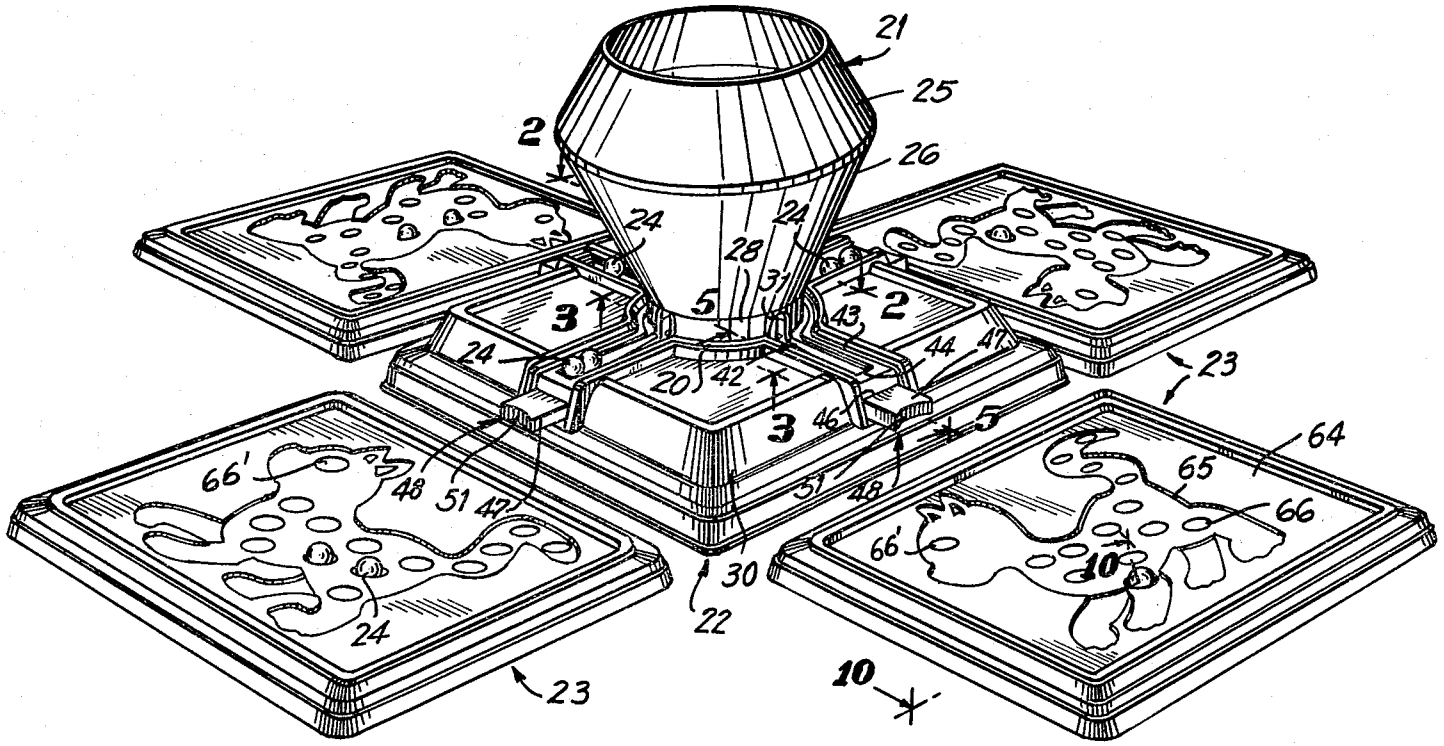
FIG. 1 is a perspective view of a preferred embodiment of the instant invention.
Figure 2:
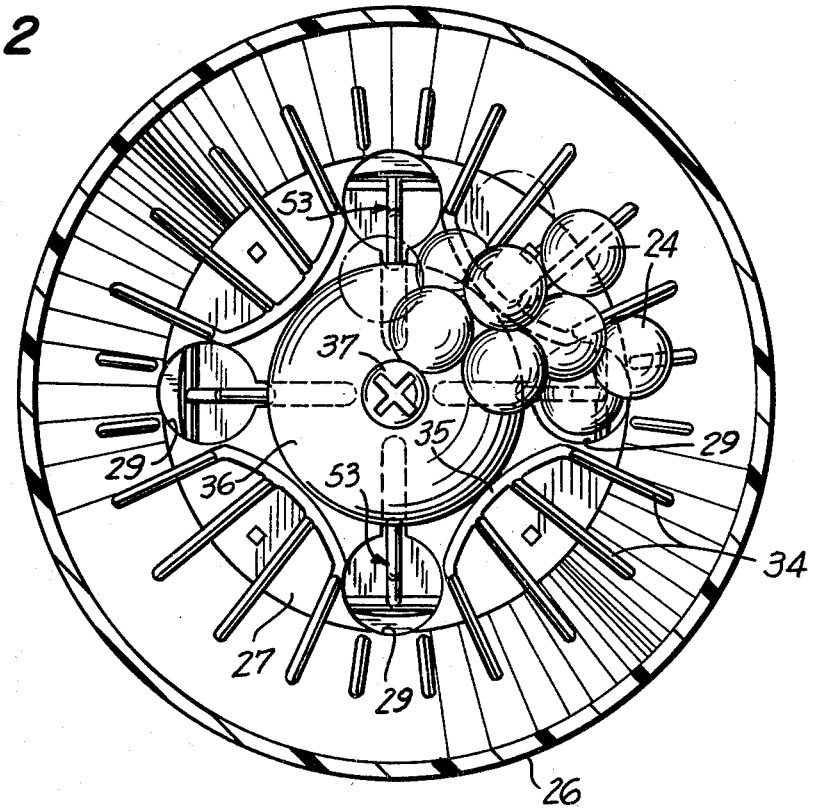
FIG. 2 is a sectional view of the gamepiece selection apparatus taken along line 2—2 of FIG. 1.
Figure 3:
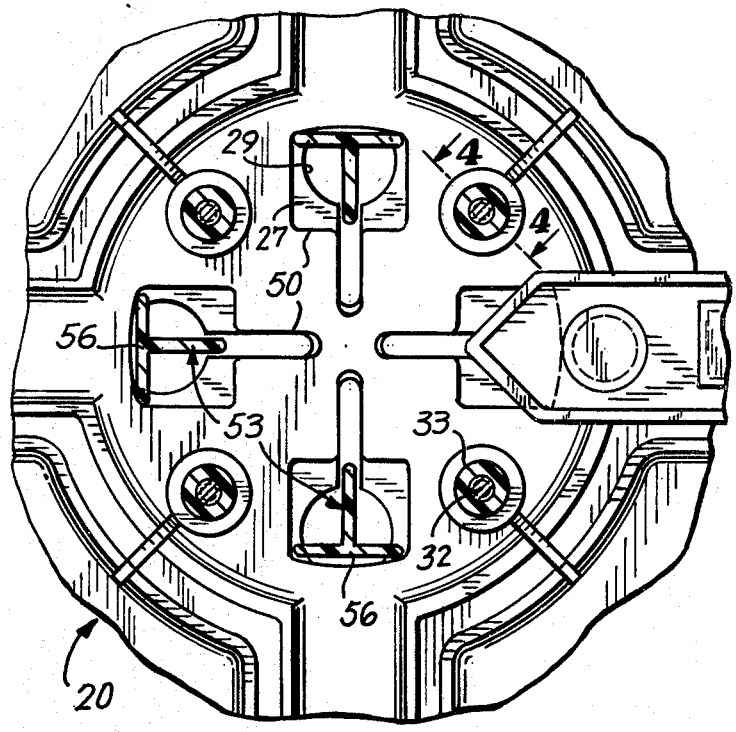
FIG. 3 is a partial sectional view taken along line 3—3 of FIG. 1.
Figure 4:
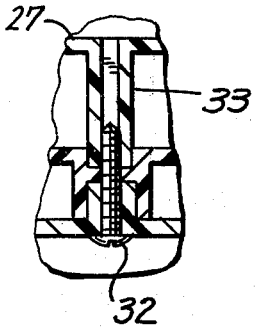
FIG. 4 is a partial sectional view taken along line 4—4 of FIG. 3.

Turning now to the drawings, the game apparatus includes a gamepiece selection device comprised of a hopper 21 for holding a plurality of gamepieces such as marbles 24, and a base 22 and a series of game boards 23. Hopper 21 has an upper section 25 in the shape of a truncated cone which tapers to a narrowest point at its upper rim and a lower section 26 in the shape of a truncated cone with a narrowest point at its lower rim. Hopper 21 also includes a circular horizontal plate 27 and a downardly extending lower rim 28. Plate 27 has a series of four openings 29 located at 90° to each other, and corresponding openings 31 are provided in lower rim 28. As will hereinafter be further described, openings 29 and 31 are constructed and arranged to allow a marble 24 to pass therethrough. Hopper 21 is mounted to base 22 by four screws 32 engaging corresponding downwardly engaging post 33 mounted to plate 27.

In order to feed marbles 24 into openings 29, lower section 26 of hopper 21 has a series of radial ribs 34. Ribs 34 slope downwardly towards the center of hopper 21. The four ribs located between each opening 29 are joined at their lower ends by means of an arcuate transverse rib 35. Also serving to guide marbles 24 into openings 29 is a convex disc 36 loosely mounted at the center of plate 27 by means of a screw 37 engaging a post 38 upstanding from plate 27. Disc 36 is moveable, in a vertical direction, as well as tiltable about post 38.

Base 22 rests on a cap 39 mounted to post 41 located at each corner. A series of troughs 42 receive marbles 24 issuing from openings 29 in hopper 21. Trough 42 has sidewalls 43, an end wall 44 and a bottom wall 45 which slopes downwardly from openings 31 in order to bias marbles 24 towards end wall 44. Base 22 has a peripheral wall 30 with slots 46 for receiving the handle end 47 of a marble release 48.

Each player has his own marble release mechanism and, for the sake of brevity, only one marble release mechanism will be hereafter described.

Each marble release 48 is slideably mounted under troughs 42 and is located by slot 46 and the sliding abutment with a bottom cover 49 which is mounted to the underside of game base 22. Handle end 47 of marble release 48 has a concave serrated end wall 51 to facilitate its sliding by means of finger pressure. The opposite end 52 of marble release 48 has an upstanding blade 53 which has a sloping front edge 54, a sloping rear edge 55 and a transverse wall 56 along its forward edge. Blade 53 extends upwardly through openings 50 in base 22 and opening 29 in plate 27, blocking the passage of marbles 24 therethrough. Marble release 48 is biased into position for blocking the release of marbles 24 by means of a coil spring 57 mounted between an abutment 58 mounted on marble release 48 and an abutment 59 extending downwardly from the underside of trough 42 on base 22. A receptacle 61 for a marble 24 is mounted between abutment 59 and transverse wall 56 of marble release 48.

Figure 5:
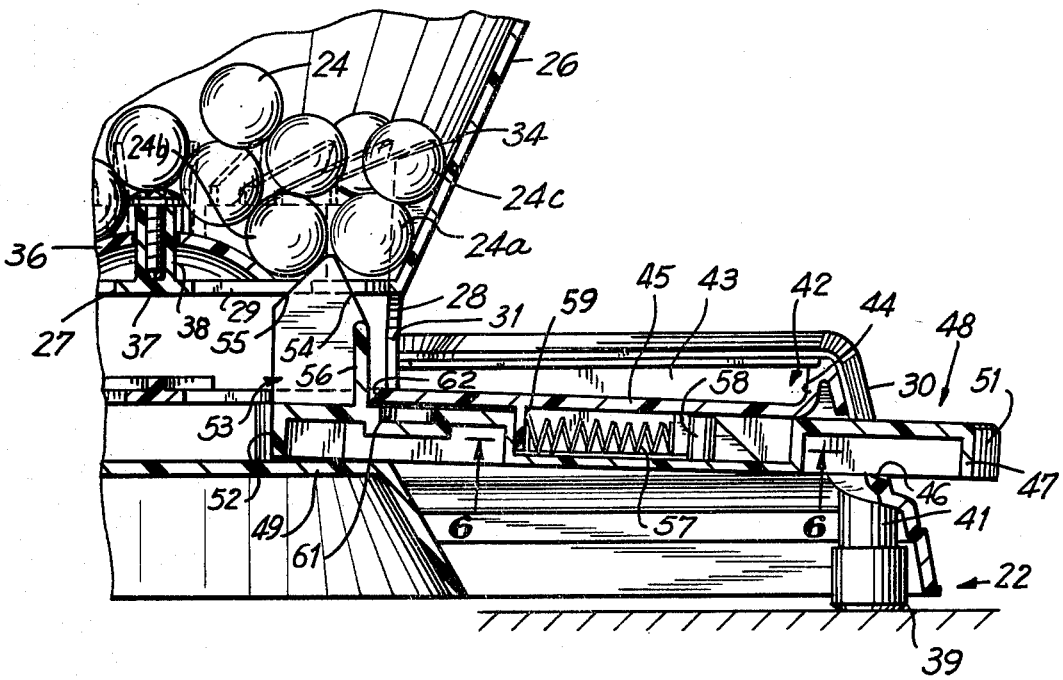
FIG. 5 is a partial sectional view taken along line 5—5 of FIG. 1.
Figure 6:
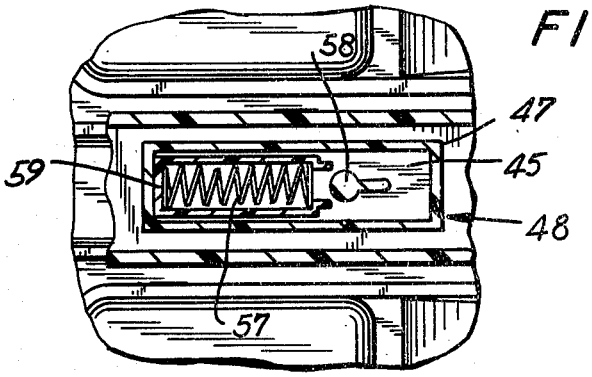
FIG. 6 is a partial sectional view taken along line 6—6 of FIG. 5.

The operation of the marble release mechanism is shown in FIGS. 5, 7 and 8. As shown in FIG. 5, spring 57 normally biases blade 53 into position closing opening 29 in plate 27, in this position, a marble 24*a* will rest against forward edge 54 of blade 53 and a second marble 24*b* will rest against rearward edge 55 of blade 53. As shown in FIG. 7, when handle end 47 of marble release 48 is moved in the direction indicated by arrow A, blade 53 will move away from opening 29 allowing marble 24*a* to drop into receptacle 61 in marble release 48. Simultaneously, marble 24*b* will be moved upwardly in the hopper by the action of rearward edge 55 of blade 53. Edge 55 will also contact and tilt upwardly convex plate 36. In this position, a third marble 24*c* will rest atop marble 24*a* and extend partially through opening 29. As shown in FIG. 8, when marble release handle 48 is released, the bias of spring 57 will cause blade 53 to move in the direction indicated by arrow B and transverse wall 56 will urge marble 24*a* over a bevelled edge 62 of trough 42 and marble 24*a* will then roll down sloping bottom edge 45 until it contacts end wall 44 of trough 42. Simultaneously, sloping front edge 54 of blade 53 will urge marble 24*c* upwardly back into hopper 21. The mechanism is now ready to repeat the process in order to select another marble.

Figure 10:
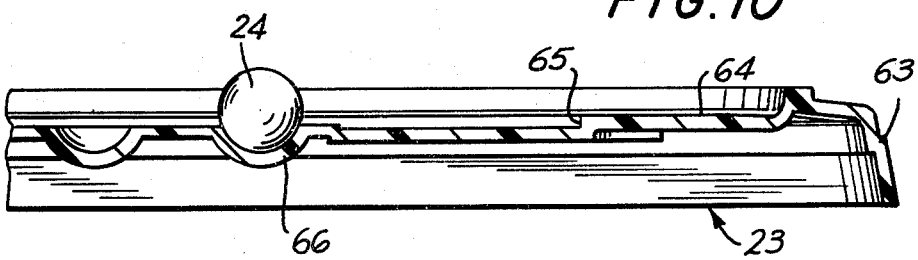
FIG. 10 is a partial sectional view of a game board taken along line 10—10 of FIG. 1.

The operator may then remove the marbles from trough 42 and place them in game board 23. Game board 23 (FIG. 10) has a peripheral rim 63 and a horizontal playing surface 64 which is marked with a design such as an animal figure. The design of a cat 65 is shown in FIG. 1. Within, or as part of, or in lieu of, the design are a series of concave marble receptacles 66 for holding marbles 24 into position on game board 23.

A preferred set of rules for play are as follows: Each game board 23 is constructed from material of a different color. Five sets of marbles are provided, four sets corresponding in color to those of game boards 23 and a fifth set consisting of four black marbles. All of the marbles are placed and mixed together in hopper 21. After a starting signal, each player begins pressing marble release handle 48 in order to cause marbles to enter trough 42. Any marble corresponding in color to that of the player's game board may be removed from trough 42 and placed into any marble receptacle 66 on game board 23, with the exception of receptacle 66', corresponding in position to the eye of the cat. All marbles of a color different from that of the player's game board 23 must be immediately returned to hopper 21. After all of receptacles 66 are filled with marbles 24 of the corresponding color, the player may then fill marble receptacle 66' with a black marble. The first person to complete his game board 23 with the black marble is the winner.

It is to be noted that the marble selecting device is not limited to use with the particular set of rules above described. But, rather, is useful whenever a random ball selection device is needed.

It will thus be seen that the objects set forth above, among those made apparent from the preceding description, are efficiently attained and, since certain changes may be made in the above construction without departing from the spirit and scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described and all statements of the scope of the invention which, as a matter of language, might be said to fall therebetween.

What is claimed is:

1. Game apparatus comprising a hopper, said hopper including a base defining a trough, a plurality of game pieces positioned within said hopper, said gamepieces being divided into at least two groups of separately identifiable gamepieces at least two distinct means associated with said hopper for removing said gamepieces therefrom upon actuation thereof, said gamepiece removal means including means for delivering said gamepieces to said trough after removal from said hopper and at least two distinct game boards having means for receiving said gamepieces placed thereon, each said gameboard including means for correlating said gameboard with one of said separately identifiable groups of gamepieces.

2. A game apparatus as claimed in claim 1 further including at least one additional separately identifiable gamepiece, each said game board including means for correlating with said additional gamepiece.

3. A game apparatus as claimed in claim 1, wherein each said game board comprises a plurality of discrete receptacles for holding individual gamepieces, the number of receptacles in said plurality corresponding in number to the number of gamepieces in one of said separately identifiable groups of gamepieces.

4. A game apparatus as claimed in claim 3, further including at least one additional separately identifiable gamepiece each said game board having a single receptacle for correlating with said additional gamepiece.

5. A game apparatus as claimed in claim 1, wherein said gamepieces comprise four separately identifiable groups, four distinct gamepiece removal means for four distinct game boards.

6. A game apparatus as claimed in claim 5, further including at least one additional separately identifiable gamepiece, said additional gamepiece correlating with all of said game boards at a single position thereon.

7. A game apparatus as claimed in claim 1, wherein said gamepieces are colored balls.

8. Game apparatus comprising a hopper, said hopper having openings for the removal of gamepieces therefrom, a plurality of gamepieces positioned within said hopper, said gamepieces being divided into at least two groups of separately identifiable gamepieces, at least two distinct means associated with said hopper for removing said gamepieces therefrom upon actuation thereof, said gamepiece removal means being reciprocable from a first position closing said openings to a second position allowing said gamepiece to pass through said openings for removal of gamepieces from said hopper and at least two distinct gameboards having means for receiving said gamepieces placed thereon, each said gameboard including means for correlating said gameboard with one of said separately identifiable groups of gamepieces.

9. A game apparatus as claimed in claim 8, and further including means for biasing said reciprocable gamepiece removal means to said first position.

* * * * *